United States Patent [19]

Eisman

[11] Patent Number: 4,848,648

[45] Date of Patent: Jul. 18, 1989

[54] MULTI-COMPARTMENT CONTAINER

[75] Inventor: Larry Eisman, Elkins Park, Pa.

[73] Assignee: Dopaco, Inc., Dowingtown, Pa.

[21] Appl. No.: 148,482

[22] Filed: Jan. 26, 1988

[51] Int. Cl.[4] ..... B65D 5/48; B65D 43/04; B65D 43/16

[52] U.S. Cl. ..... 229/114; 206/561; 229/120.17; 229/125.01; 229/148; 229/906

[58] Field of Search ..... 229/113, 114, 120.16, 229/120.17, 145, 146, 148, 902, 906, 125.26, 125.29, 125.01; 206/561

[56] References Cited

U.S. PATENT DOCUMENTS

| | | | |
|---|---|---|---|
| 1,170,776 | 2/1916 | Nagle | 229/120.16 |
| 2,214,525 | 9/1940 | Murguiondo | 229/120.17 |
| 2,839,236 | 6/1958 | Dunning | 229/148 |
| 3,084,790 | 4/1963 | Vanderlugt, Jr. | 229/120.17 |
| 3,863,832 | 2/1975 | Gordon et al. | 229/903 |
| 3,876,132 | 4/1975 | Kuchenbecker | 229/120.17 |
| 4,301,960 | 11/1981 | Alexander et al. | 229/120.17 |
| 4,360,147 | 11/1982 | Braumer | 229/148 |
| 4,763,832 | 8/1988 | Forbes, Jr. | 229/902 |

FOREIGN PATENT DOCUMENTS

| | | | |
|---|---|---|---|
| 807106 | 1/1934 | France | 229/120.17 |

*Primary Examiner*—Gary E. Elkins

*Attorney, Agent, or Firm*—Dennison, Meserole, Pollack & Scheiner

[57] ABSTRACT

A multi-compartment carton folded from a unitary cardboard blank and including a central partition defined by a pair of generally spaced partition panels. The opposed ends of the partition section incorporate laterally directed glue flaps which adhesively bond to opposed aligned pairs of side walls. The side walls, along each side of the formed compartments, in turn include projecting integral extensions which overlie and bond to each other above and independently of the glue flaps to provide a rigid interlock of the aligned walls and a rigid fixing of the compartments relative to each other. Closures, either unitary with the blank of the carton or as separate lids, close and segregate the defined compartments.

14 Claims, 4 Drawing Sheets

MULTI-COMPARTMENT CONTAINER

BACKGROUND OF THE INVENTION

The proliferation of fast food establishments has resulted in an ever-expanding variety of foods to attract the consumer. Currently, it has become increasingly popular to serve diverse foodstuffs in a single container, partitioned in accord with the different foodstuffs to be simultaneously received therein. This has usually necessitated the use of vacuum formed foam styrene containers rather than the more simply constructed and economically desirable paperboard or cardboard containers.

Cardboard has been used to form what is commonly referred to as a clam shell container comprising a single-cavity tray portion with a cavity-defining lid pivoted thereto whereby spearated foodstuffs can be presented to the customer for combining at the time of consumption, normally immediately subsequent to purchase. Such containers can, as an example, be used for separating a warm cooked hamburger from chilled lettuce and tomatoes to be applied thereto at the time of consumption, thus maintaining the optimum temperature for both foodstuffs until combined for consumption. However, such containers, in light of the folding hinge construction between the cavities, are not particularly suited for retaining separated foodstuffs which are to be consumed separately. In addition, such containers are not particularly adapted for transporting separated foodstuffs for consumption at a later time in that such containers, until the sections are closed one upon the other, are not conveniently covered.

SUMMARY OF THE INVENTION

The container or carton of the present invention is formed from a single blank of appropriate sheet material, preferably paperboard or cardboard, to define separate, adjacent compartments rigidly interconnected by a formed partition between each adjacent pair of compartments. The folded carton can be utilized as an opened multi-compartment tray, a tray which receives a separate closure for completely segregating the formed compartments, or a tray with an integral hinge lid.

The rigid partition between adjacent compartments is defined by dual walls joined in rigid spaced relation to each other to provide a substantial degree of thermal insulation between the compartments. The formed compartments are thus particularly adapted to effectively accommodate hot and cold products in adjacent compartments in an effectively segregated manner. The segregation of the products is enhanced by the particular capability of the carton to accommodate a closure lid which, at least in one form, will sit on and seal directly to the partition itself.

The carton, in accord with the present invention, is folded from a single blank with minimal material waste. The actual folding of the blank is easily effected along pre-defined fold lines either manually or, in the case of large volume production, by readily available automated equipment.

A basic carton in accord with the invention will comprise a thin blank of paperboard or cardboard folded to define a pair of compartments rigidly joined in coplanar relation to each other by a transverse partition. The partition includes a pair of divergent walls, each comprising the inner wall of a corresponding compartment. Each compartment will also include an opposed outer end wall and a pair of side walls, each of greater height than the partition.

In order to rigidly define the compartments, the opposed ends of the partition walls include laterally directly glue flaps which overlie the inner portions of the adjacent compartment side walls. In turn, the inner ends of the corresponding side walls of the two compartments, along a common edge of the carton, include longitudinal extensions which overlap and are glued to the companion side wall above the glue flaps to complement the holding force of the glue flaps, rigidify the side walls, and stabilize the compartments relative to each other against any tendency to fold or pivot about the partition.

The blank from which the basic form of multi-compartment carton is formed is basically a rectangular blank including a pair of longitudinally aligned base panels separated by a transversely extending partition-forming section adapted to fold upward between the two base panels and define a pair of spaced inner walls projecting upwardly from the base panels.

The opposed sides of each base panel have longitudinally extending integral side wall panels which fold upwardly about folds lines to define the opposed side walls of the compartments. The outer extremities of the two wall panels of the partition section include integrally joined glue flaps which extend between the inner ends or edges of the adjacent end portions of the aligned side wall panels along each side of the blank. These adjoining end portions in turn include longitudinally extending extensions which meet at the central line of the partition section immediately outward of the corresponding glue flaps. Upon an upward folding of the partition section and the side wall panels, the glue flaps engage against the side wall panels at the adjacent end portions thereof for adhesive securement thereto. At the same time, the side wall extensions, upon an inward movement of the base panels and side wall panels resulting from an upward deformation of the partition, move into overlapping engagement with each other for adhesive securement. The basic carton is completed by outer end wall panels opposed from the partition section. The end wall panels in turn include glue flaps on the opposite extremities thereof which, upon an upward folding of the end panels, overlap and are adhesively bonded to the adjacent side wall panels.

The waste in the blank as above described is minimal, consisting only of small triangular cutouts between the partition section glue flaps and the side wall extensions, and the angular severing of the four corners of the blank for a proper configuration of the end corner glue flaps.

Variations include the provision of more than two compartments, the use of an extended blank to define an integral closure lid, and the use of the basic multiple-compartment carton with a removable lid. In each instance, the basic partition forming construction, which defines rigid, segregated compartments, remains the same.

Other objects and advantages of the invention reside in the details of the invention as more fully hereinafter described and claimed.

DESCRIPTION OF PREFERRED EMBODIMENTS

Figure 1:
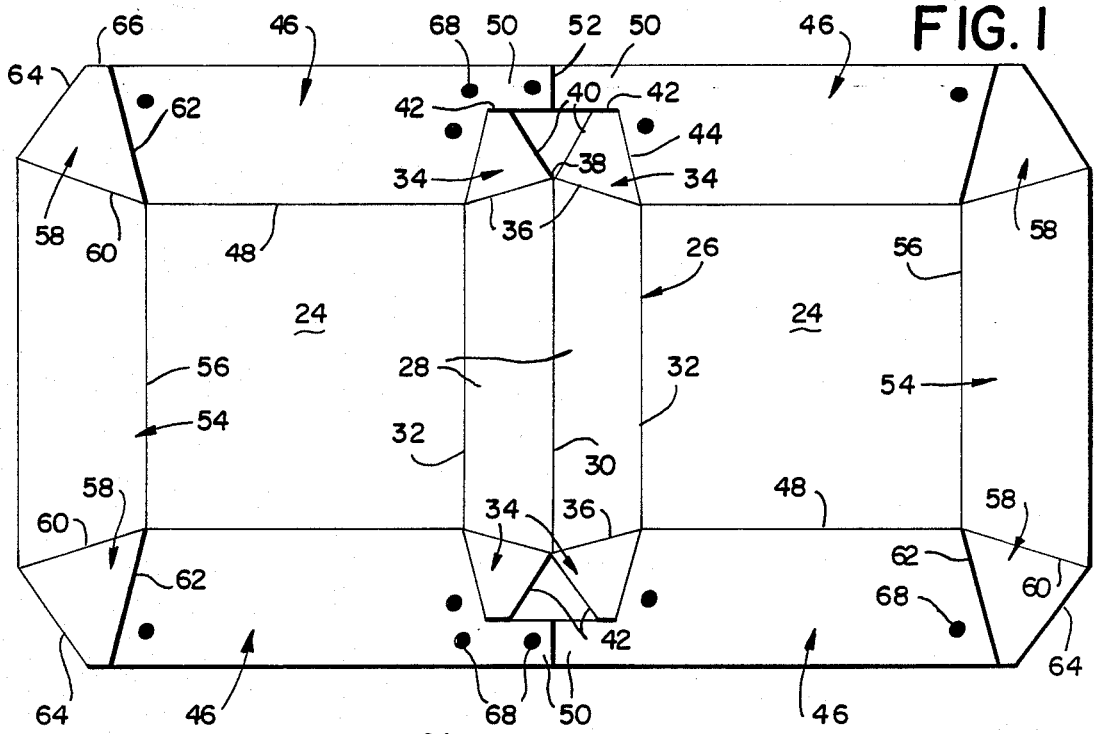
FIG. 1 is a plan view of a blank in accord with the present invention.

Referring now more specifically to the drawings, FIGS. 1–4 illustrate a basic form of the invention wherein a two-compartment carton 20 is formed from a one-piece blank 22 of paperboard or cardboard of the type conventionally used in takeout food cartons.

The blank 22 is of an elongate rectangular configuration with the four corners thereof removed. The blank 22 includes a pair of longitudinally aligned base panels 24 with a transverse partition section 26 therebetween. The partition section 26 includes two elongate partition panels 28 extending transversely across the blank 22 and integrally joined along a center fold line 30. Each of the partition panels 28 is in turn integrally joined to an adjacent base panel 24 along a fold line 22.

The opposite ends of each of the partition panels 28 include generally triangular glue flaps 34 extending longitudinally of the partition panels 28 and integrally joined thereto along fold lines 36. The fold lines 36 at each end of the partition section 26 meet at the corresponding end 38 of the center fold line 30 and diverge outwardly therefrom, at a minor degree to the horizontal, to the opposed base panel fold lines 32. The glue flaps 34 at each end of the partition section 26 include free inner edges 40 which diverge outwardly from the corresponding fold line end 38 and terminate in free outer truncated flap ends 42. The outer edges 44 of each pair of adjoining glue flaps 34 are also free edges or edges defined from the blank by cutlines. These edges 44 diverge inwardly from the flap ends 42 at a lesser angle than the angle of the inner free edges 40 and terminate at the juncture between the corresponding fold lines 32 and 36.

A pair of longitudinally extending side wall panels 46 are integral with each base panel 24 along side fold lines 48 which at the inner ends thereof meet the joinder of corresponding fold lines 32 and 36. The side wall panels 46 are of a greater transverse width than the corresponding glue flaps 34 and extend laterally outward therebeyond. The inner end portion of each of the side wall panels 46 includes an integral extension 50 transversely outward of the truncated peak 42 of the corresponding glue flap 34 and extending longitudinally inward beyond the glue flap to a point generally transversely aligned with the central fold line 30. The extensions 50 of a pair of adjacent side wall panels 46 will have the free inner ends thereof defined by a cut line 52 therebetween. Alternatively, these free inner ends of the extensions 50 can be spaced to define a specific space therebetween. The inner end portion of each of the side wall panels 46, transversely inward of the extension 50, has the free inner edge thereof defined by the cut line 44.

An end wall panel 54 extends transversely of each base panel 24, parallel to the partition section 26, and is integral with the base panel 24 along a fold line 56, the opposite ends of which terminate at the outer ends of the longitudinally extending fold lines 48.

The opposed ends of each of the end wall panels 54 have glue flaps 58 integral therewith along fold lines 60. The fold lines 60 of each end wall panel 54 diverge outwardly from the corresponding outer ends of the longitudinally extending fold lines 48. The remaining two edges of each glue flap 58, formed respectively by a cut line 62 between the glue flap 58 and the adjoining side wall panel 46, and the diagonally cut outer corner edge 64 define a triangular configuration terminating in a truncated peak 66 in general longitudinal alignment with the outer edge of the corresponding side wall panel 46. Either at the time of formation of the blank or immediately prior to erection thereof into the carton 20, adhesive 68 is provided at locations wherein the various glue flaps and extensions overlap the corresponding side and end wall panels for a bonding therebetween. It will be noted that the only waste material, assuming a continuous strip of material, will be the small triangular sections defined between the partition section glue flaps 34, and the small triangular sections at the four corners.

Figure 2:
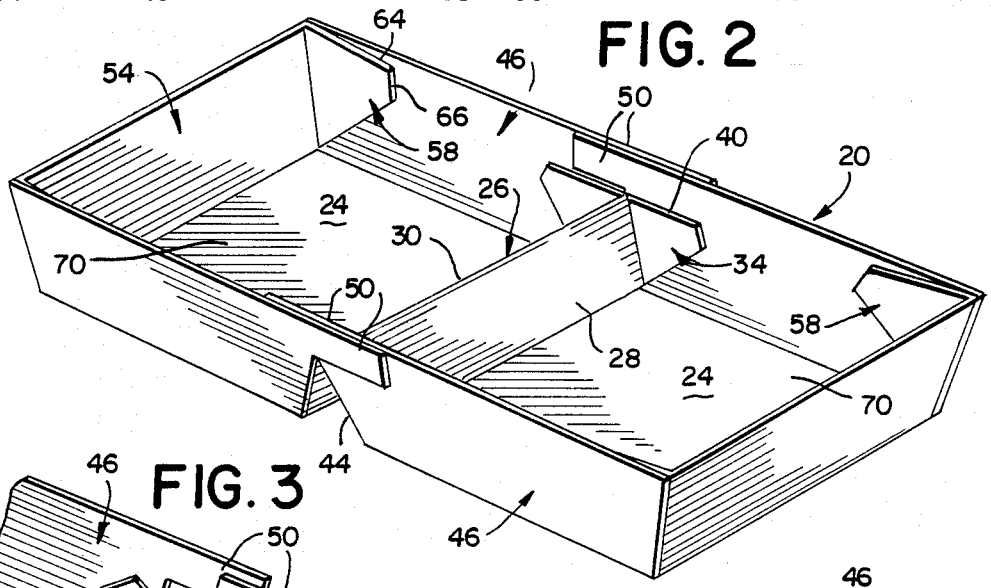
FIG. 2 is a perspective view of a two-compartment tray or carton formed in accord with the present invention from the blank of FIG. 1.
Figure 3:
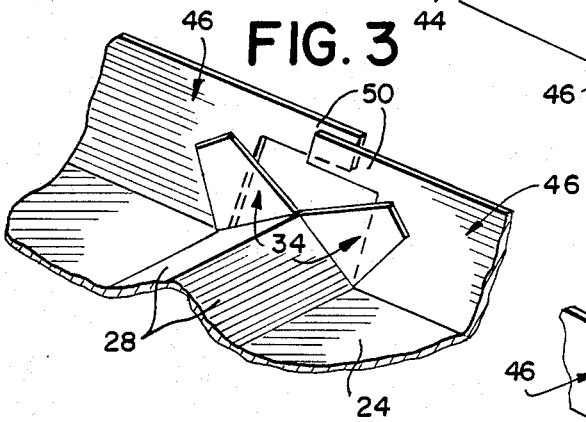
FIG. 3 is a perspective detail of a partially folded partition end illustrating internal positioning of the glue flaps.

The blank 22, when folded, forms the multi-compartment carton 20 of FIG. 2. One manner of folding the carton, particularly adopted for automated equipment, involves longitudinally inwardly moving the base panels 24 toward each other and causing the partition section 26 to upwardly peak along the central fold line 30. The upward folding of the partition section 26 will simultaneously result in an overlapping of the end extensions 50 on the aligned pair of side wall panels 46. One extension of each pair of extensions 50 will be slightly upwardly deflected to properly overlie the companion extension with the adhesive area therebetween. Simultaneous with or immediately subsequent to the folding of the partition section 26, the glue flaps 34 and 58 will be slightly upwardly deflected to properly position interiorly within the carton 20. Finally, the side wall panels 46 and end wall panels 54 are upwardly folded into the wall-forming configurations thereof, bringing the respective glue flaps into intimate engagement with the pre-applied adhesive. A partially unfolded detail at one end of the partition section 26 and the adjoining inner end portions of the side wall panels 46 will be noted in FIG. 3. As will be recognized from the drawings, each formed side wall is planar with a free upper edge.

In order to provide for both segregation and insulation between the two formed compartments 70 of the carton 20, the partition panels 28 diverge outwardly and downwardly relative to each other from the central peak 30 whereby a substantial space is defined therebetween. Should an additional spacing be deemed desirable, the peak fold line 30 can actually constitute a strip or flattened area defined by a pair of laterally spaced fold lines with each partition panel depending from one of the pair of fold lines. The side and end walls defined by the panels 46 and 54 incline slightly outward from the corresponding base panel 24, facilitating stacking as well as both the introduction and the removal of foodstuffs. The actual angle of inclination is determined by the angle of the respective fold lines 36 and 60 associated with the glue flaps. Similarly, the cut lines 40, of the intermediate glue flaps 34, and 64 of the outer glue flaps 58, are so directed as to present a substantially horizontal edge in the folded carton 22 with the truncated ends 42 and 66 being generally vertically directed to avoid sharp projections.

The partition panels 28 are of a transverse width less than that of the side and end wall panels 46 and 54 whereby the formed partition in the carton 20 is of a lesser height than the formed walls. The overlying adhesively secured side wall extensions 50 are positioned immediately above the corresponding glue flaps 34 and effectively lock the compartments 70 in rigid longitudinal alignment against any tendency for the cartons to fold about the peak fold line 30. The secured extensions 50 also cooperate with the corresponding glue flaps 34 in providing for a highly stable rigidification of the formed side walls, adding a lateral stability thereto not obtainable from the glue flaps themselves.

Figure 4:
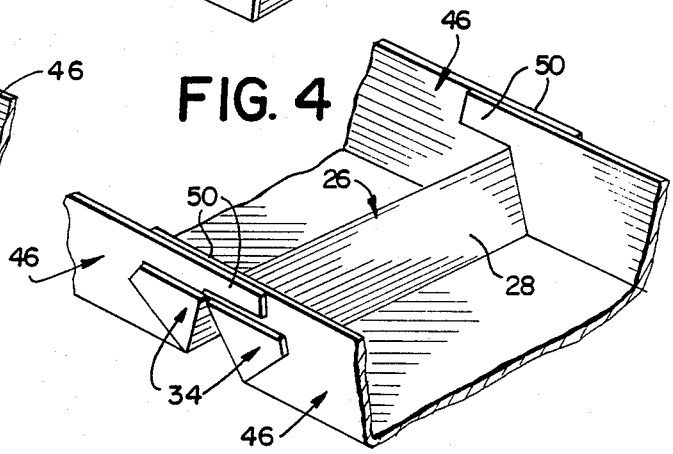
FIG. 4 is a partial perspective view of the partitioned portion of a folded carton with the glue flaps externally positioned.

FIG. 4 details a variation of the rigidifed partition and side wall joinder wherein the glue flaps 34 are folded to overlie the outer faces of the end portions of the adjacent aligned side wall panels 46, providing a smoother interior surface to the carton compartments 70.

Figure 5:
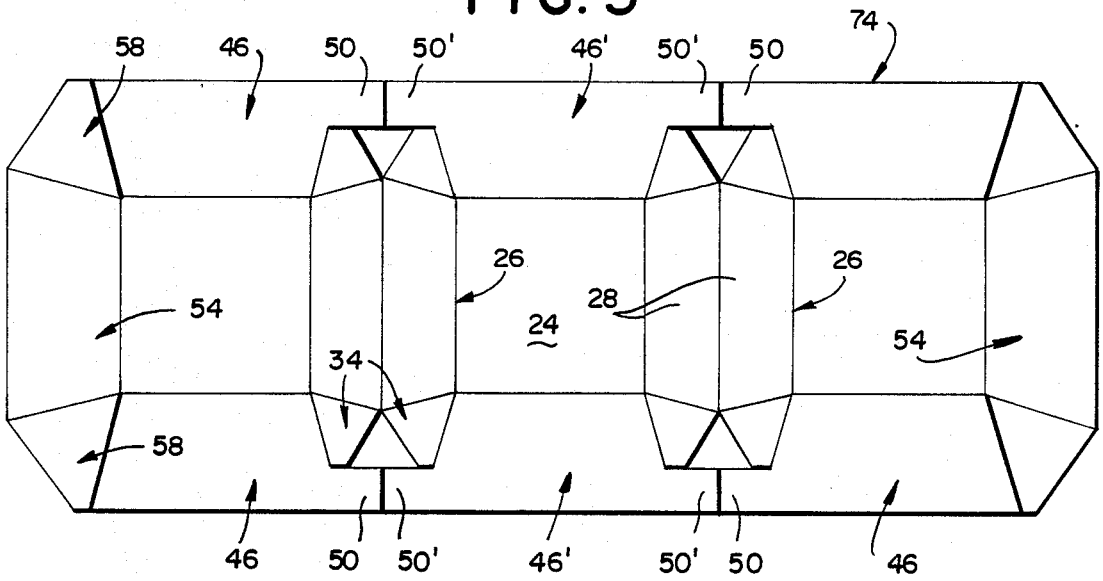
FIG. 5 is a plan view of a blank utilized in the formation of three segregated compartments.
Figure 6:
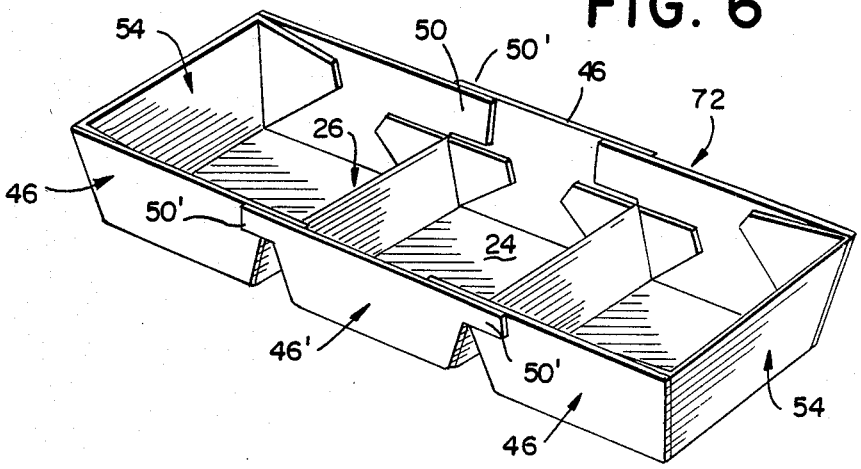
FIG. 6 is a perspective view of a three-compartment carton formed from the blank of FIG. 5.
Figure 10:
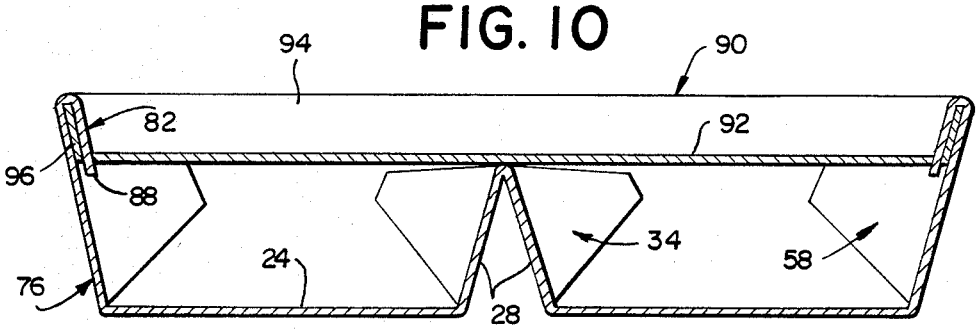
FIG. 10 is a longitudinally sectional view through a fully assembled carton and lid as in FIG. 9.
Figure 7:
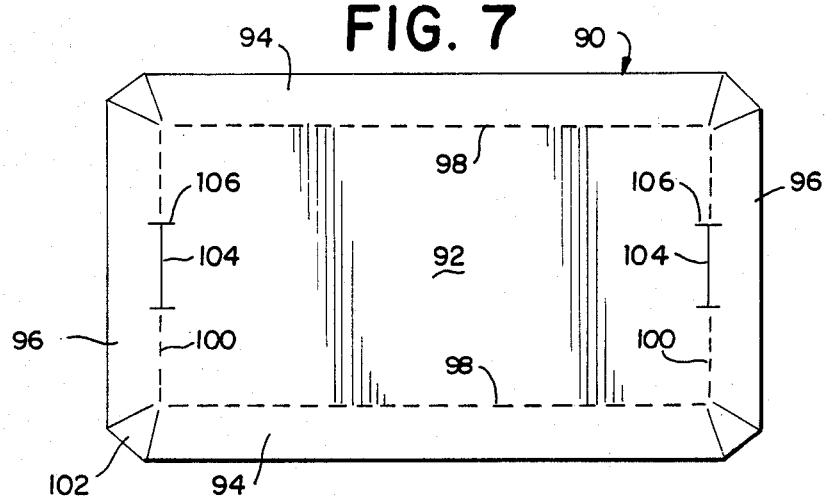
FIG. 7 is a blank utilized to form a closure lid.

FIGS. 5 and 6 illustrate a variation wherein the folded multi-compartment carton 72 includes three segregated compartments. The carton 72, as well as the unitary blank 74 from which it is formed, differ from the carton 20 and blank 22 only in the provision of two-spaced transversely extending partition sections whereby the intermediate compartment has the longitudinally spaced transverse walls thereof defined by two partition sections, rather than one partition section and an end wall as in the carton 20. In view of the substantial duplication of components between the embodiment of FIG. 6 and the embodiment of FIG. 2, with their associated blanks, like reference numerals have been used. Incidentally, in order to accommodate the intermediate compartment of the carton 72, it will be appreciated that the central side wall panel along each side of the blank, designated as 46', has both end portions thereof provided with wall overlapping extensions 50' to cooperate with the similar extensions 50 on the endmost side wall panels 46.

From the embodiment of FIGS. 5 and 6, it will be appreciated that the number of formed compartments can vary, within limits, in accordance with the number of foodstuffs to be combined in a single carton.

Figure 8:
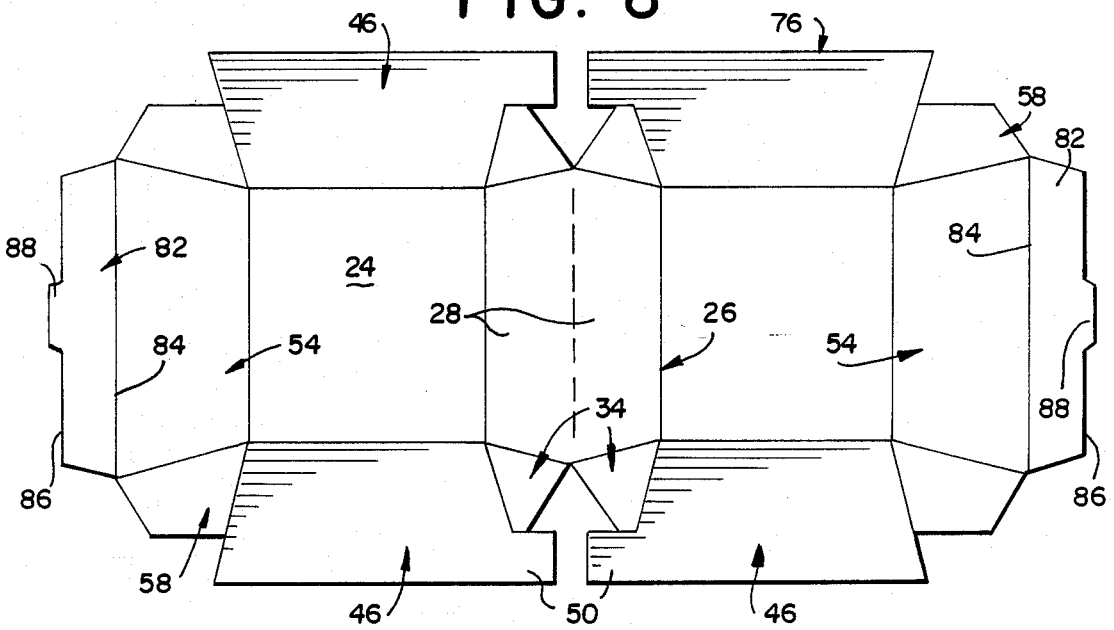
FIG. 8 is a plan view of a blank similar to the blank of FIG. 1 and modified to accommodate a separate closure lid formed from the blank of FIG. 7.
Figure 9:
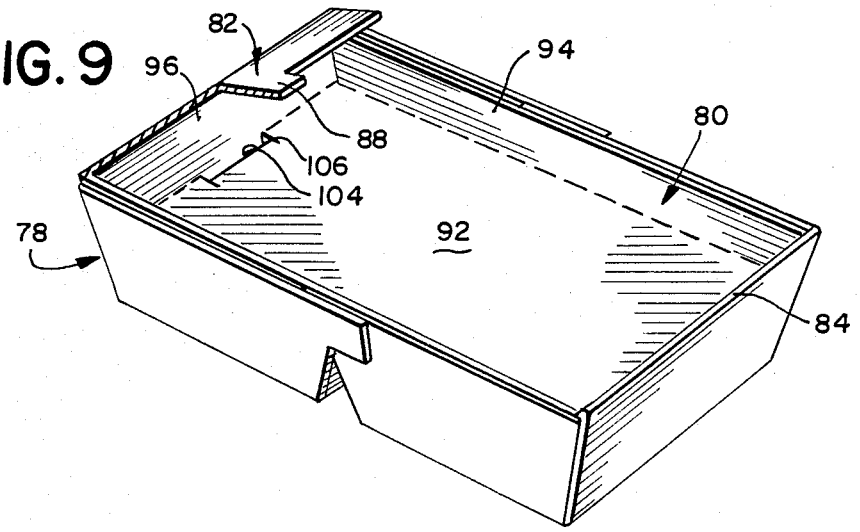
FIG. 9 is a perspective view of a carton and closure lid formed from the blanks of FIGS. 7 and 8 and partially broken away for purposes of illustration.

FIGS. 7–10 are directed to a variation of the basic carton, and in particular the carton of FIG. 2. The blank 76 of this variation is illustrated in FIG. 8 with those components of the blank 76 which duplicate those of the blank 22 in FIG. 1 being designated by the same reference numerals in that the aforedescribed structural relationships, manipulative steps, and advantages derived equally apply to the blank of FIG. 8 and the carton 78 formed therein.

The carton 78 is particularly adapted to receive a closure lid 80 nested within the slightly inclined side walls of the carton 78 and resting in sealing engagement with the peak of the central partition or partitions to effectively segregate the compartments to the opposite sides of the partitions. Accordingly, and as will be appreciated from FIG. 8, the side wall panels 46 and end wall panels 54 are of a slightly greater transverse width to conveniently accommodate the lid 80 which, as illustrated, is in the form of a shallow tray. The greater width side walls also result in a greater width to the extensions 50. Further minor changes will be noted in the specific spacing of the inner ends of the extensions and the foreshortening of the outer corner glue flaps 58. The extensions 50 of course maintain sufficient lengths so as to achieve the desired rigidifying overlap.

The major change in the blanks 76 is the provision of transverse end retaining panels 82, one coextensive with the outer edge of each end wall panel 54 and integral therewith along an edge-defining fold line 84. The outer edge 86 of each retaining panel 82 is in turn provided with a coplanar centrally located elongate tab 88, the purpose of which shall be explained presently.

The tray-defining lid 80 is defined from a unitary blank 90. The blank 90 includes a central base panel 92 with opposed longitudinally extending side panels 94 and opposed transversely extending end panels 96 each integrally joined to the base panel 92 along coextensive fold lines 98 for the side panels and 100 for the end panels. Triangular glue flaps 102 are provided at each of the corners of the blank 90. The angular extent of the opposed ends of each of the side and end panels 94 and 96 provide, upon a folding of the side and end panels, peripheral walls incline slightly outward from the base panel 92 at an angle corresponding to the angle of the walls of the folded carton 78. The size of the formed lid 80 is such as to snuggly engage within the upper portion of the carton 78. Further, the height of the walls formed by the side and end panels 94 and 96 is less than the height of the carton walls above the plane of the partition peak with the lid sitting in a sealed engagement at the partition peak simultaneous with a snug engagement of the peripheral lid walls with the carton walls.

In order to provide for a positive retention of the lid 80 within the carton 78, the retaining panels 82 are folded inward over the end walls of the received lid 80 and the associated locking tabs 88 received within corresponding slots 104 defined centrally along the end panel fold lines 100 of the blank 90. The slots 104 will tend to open slightly upon a folding of the end panels 96, thereby facilitating insert of the tabs 88. Further, each of the slots 104 includes a transverse slit 106 at each end thereof. This slit in the base panel 92, will provide for an increased degree of flexure to the portion of the base panel immediately adjacent the slit 104 whereby engagement and disengagement of the corresponding tab 88 is facilitated. The transverse width of the retaining panel 82 is to be substantially equal to the depth of the lid 80 to position the outer edge 86 of each retaining panel in engagement with or closely adjacent to the lid base panel 92 for an additional retention thereof.

Figure 11:
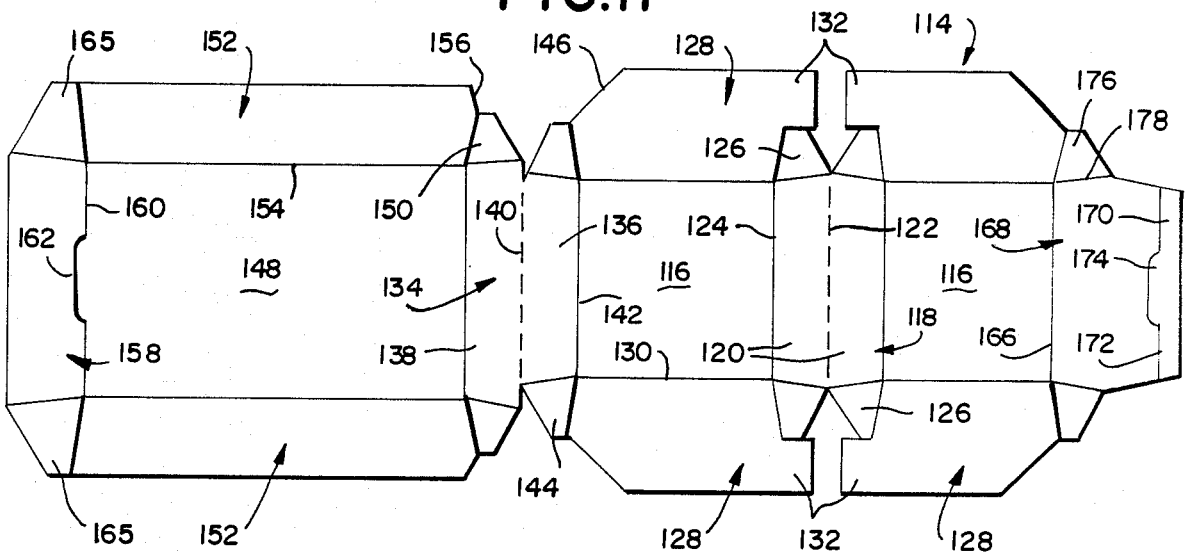
FIG. 11 is a plan view of a further blank.
Figure 12:
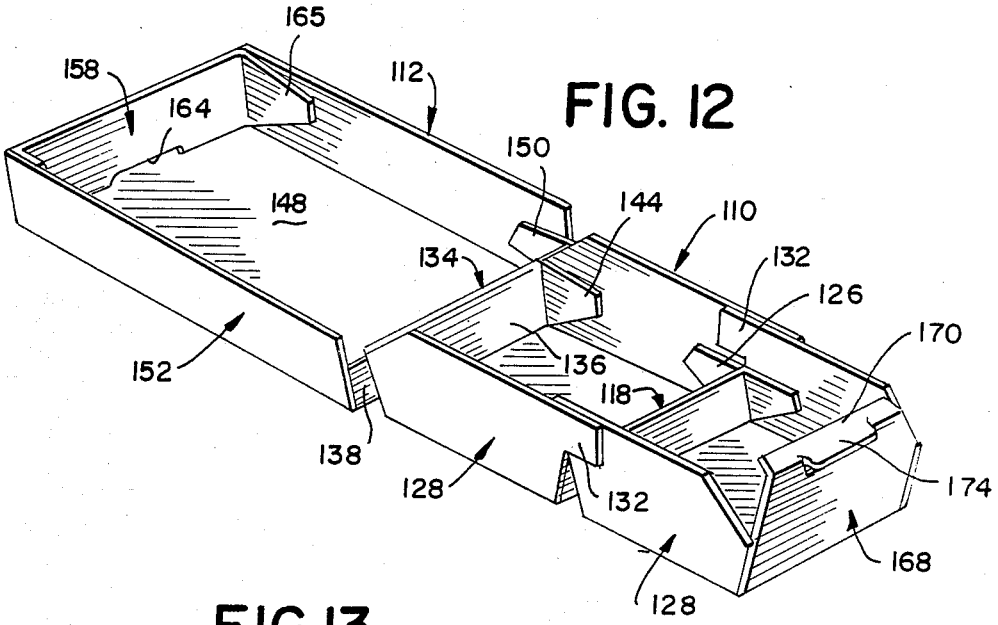
FIG. 12 is a perspective view of a two-compartment carton with an integral hinge closure lid formed from the blank of FIG. 11.
Figure 13:
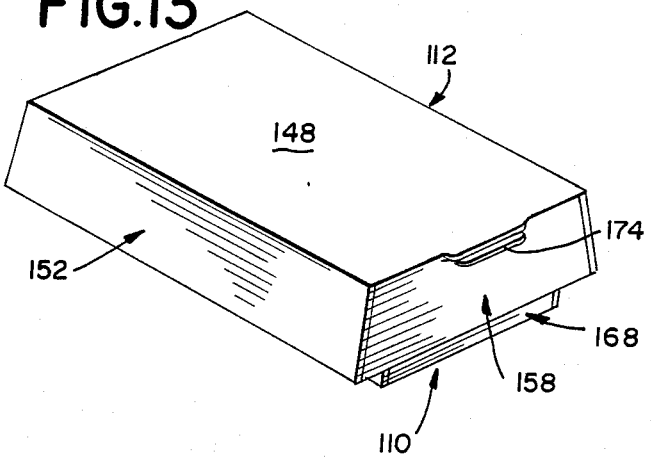
FIG. 13 is a perspective view of the carton of FIG. 12 with the lid closed.

FIGS. 11–13 illustrate a further variation wherein the carton 110 is formed with an integral closure or lid 112, both folded and defined from a one-piece elongate blank 114. While the compartment 110, as with the previously described variations, can include two or more compartments, for purposes of illustration, the carton 110 has been shown in a two-compartment configuration.

In order to define the two compartments, the carton portion of the blank 14 includes a pair of longitudinally aligned base panels 116 separated by a partition section 118 comprising two partition panels 120 extending transversely across the blank 114 and integrally joined along a peak-defining fold line 122. Each of the partition panels 120 is internal with the corresponding inner edge of an adjacent base panel 116 along fold line 124. The opposed ends of each partition panel 120 include generally triangular glue flaps 126.

Side wall panels 128 are integral with the base panels 116 along longitudinal side fold lines 130. Each of these side wall panels 128 include inner end portions having extensions 132 longitudinally directed for overlapping engagement with an aligned side wall panel 128 immediately above the engaged glue flaps in the folded carton 110. The carton construction thus far described substantially duplicates that of the previously described cartons both structurally and functionally with the major feature being the partition section 118 with associated glue flaps 126 and the specifically configured inner end portions of the side wall panels 128 with the unique rigidifying and structurally stabilizing extensions 132. While not specifically illustrated, it will be appreciated that the overlapping components are to be adhesively bonded.

The lid-forming portion of the blank 114 is longitudinally aligned with the carton forming portion and integral therewith through an intermediate hinge section 134 which extends transversely of the blank 114. The hinge section 134 includes a pair of hinge panels 136 and 138 integrally joined along a central hinge line 140. The hinge panel 136 is integral along one end of an endmost base panel 116 along a fold line 142 and includes glue flaps 144 at the opposed ends thereof. The hinge panel 136 and associated glue flaps 144 substantially duplicate the opposed partition panel 120 with its glue flaps 126 for similar engagement with the corresponding side wall panels 128 when folded. The corresponding end portions of the side wall panels 128 adjacent the hinge panel 136 differ from the opposite ends thereof in that there are no rigidifying extensions. Rather, each of these end portions is defined by a beveled or angled edge 146 angling away from the corresponding glue flap 144 to the outer edge of the corresponding side wall panel 128.

The lid-forming portion of the blank 114 includes an elongate rectangular base panel 148 of a slightly greater length and width than the combined base panels 116 whereby, in the formed construction, the lid 112 will properly engage over and seal the carton 110.

The second hinge panel 138 substantially duplicates the hinge panel 136 and is of a slightly greater transverse length to accommodate the wider lid base panel 148. This hinge panel 138 also includes glue flaps 150 integral with the opposed ends thereof along appropriate fold lines for cooperative adhesive bonding to the adjacent end portions of side wall panels 152. The side wall panels 152 are coextensive with the longitudinal edges of the base panel 148 and integral therewith along full length fold lines 154. The inner end portions of the side panels 152 adjacent the glue flaps 150 are without extensions and include beveled or angled edges 156 which incline away from the corresponding glue flap 150 outward thereof.

Noting FIGS. 11 and 12 in particular, it will be appreciated that while the structure of the partition section 118 and hinge section 134 is basically similar, there is a major difference in these joinder areas in the use of the side wall panel extensions 132 to cooperate with the partition section 118 in defining a rigid non-hinging carton with longitudinally aligned fixed position compartments. The absence of such extensions on the side wall panels 128 and 152 adjacent hinge section 134 allows for a free hinging or pivoting of the lid 112 relative to the carton 110 about the integral hinge line 140 with the beveled edges 146 and 156, as well as the outward spacing of the side walls defined by the panels 152, providing for a smooth movement of the lid 112 into telescopically overlying relation to the carton 110 as in FIG. 13.

The outer end of the base panel 148 of the lid portion includes an end wall panel 158 transversely thereacross and integral therewith along fold line 160. Centrally therealong the fold line 160 is interrupted and an elongate tab 162 cut into and along the adjoining inner edge of the end wall panel 158. This tab 162 defines a slot 164 through the base of the end wall formed from the panel 158 in the erected condition of the carton lid 112 as illustrated in FIG. 12. Note that the end wall panel 158 also includes integral end glue flaps 164 for adhesive bonding to the corresponding end portions of the side wall panels 152 in the erected construction.

Along the opposite end of the blank 114 and integral with the outer end edge of the outer base panel 116 along fold line 166 is a transversely extending end wall panel 168. The end wall panel 168 is of equal transverse width with the side wall panels 128 and has a coextensive narrow lip 170 integral with the outer edge thereof along fold line 172. Centrally therealong, the fold line 170 is interrupted and a tab 174 cut from the outer edge portion of the end wall panel 168 to define a continuation of the lip 170. Noting FIG. 12, in the formed carton 110, the lip 170 is folded inward with the associated tab 174 outwardly directed relative to the formed end wall.

The end wall panel 168 includes glue flaps 176 integral with the opposed ends thereof along fold lines 178. These glue flaps 176 are of a width equal to approximately one-half of the width of the corresponding end wall panel 168 with the adjoining end edges of the corresponding side wall panels 128 beveled or angled at an obtuse angle to the outer end of the corresponding glue flap 176. Configured in this manner, and noting FIG. 12, in the erected carton the outer portion of the end wall defined by the panel 168 constitutes an extension without direct side wall support so as to provide for a minor degree of flexibility desirable in opening and closing the carton lid. In regard thereto, and as will be appreciated from the drawings, as the carton lid 112 is hinged over the carton 110 to the close position thereof, the tab 174 will engage the inner surface of the end wall panel 158 with the outer portion of the inner wall panel 168 flexing slightly inward until the tab 174 aligns with the formed slot 164. At that point, the tab 174 will snap into the slot 164 through the inherent resiliency of the end wall panel 168 and provide an effective locking of the lid 112 to the carton 110. With this engagement, access to foodstuffs within the container is easily effected by a mere manual inward flexing of the end wall 168 and in particular the outer portion thereof.

It will be recognized that a common feature in all of the disclosed variations is the central partition section with the side wall end portions which uniquely cooperate, through adjesively secured extensions, to produce a rigid multiple compartment carton folded from a unitary blank.

The foregoing is considered illustrative of the features of the invention. Other variations may occur to those skilled in the art utilizing the described inventive features. Accordingly, it is not desired to limit the invention to the specific embodiments illustrated. Rather, the invention is to only be limited by the scope of the claims following hereinafter.

I claim:

1. A carton folded from a one-piece blank of paper board, said carton comprising multiple longitudinally aligned compartments, a transverse partition between each adjacent pair of compartments, each compartment including a base panel with longitudinally extending planar side walls integrally folded upward from opposed sides of the base panel and terminating in free upper edges, each said transverse partition being attached to the base panels of the adjacent compartments, glue flaps bonding said partition to the side walls of the adjacent compartments below the free upper edges of said side walls, each side wall adjacent the partition having a substantially coplanar longitudinally extending extension vertically above the glue flaps and overlapping a similar extension on an aligned side wall of the adjacent compartment, means rigidly securing the overlapped extensions to each other to preclude movement between the corresponding side walls, said compartments including endmost compartments, and carton end walls extending transversely across the endmost compartments between the side walls thereof.

2. The carton of claim 1 including at least three longitudinally aligned compartments.

3. The carton of claim 1 wherein said side walls and end walls are of a greater height than each said partition, and a closure lid overlying said compartments and engaging each said partition, said lid having peripheral walls closely received within the walls of the carton above the height of each said partition.

4. The carton of claim 1 including a lid, hinge means integrally hinging the lid to and along the upper edge of one of said end walls for selective pivotal closure over the carton, a tab extending from the end wall remote from the lid along the upper portion thereof, said lid including an end wall remote from said hinge means, said lid end wall having a slot defined therethrough selectively receiving said tab upon closure of the lid.

5. The carton of claim 4 wherein the carton end wall remote from the lid is laterally flexible for a sliding engagement with the lid end wall and a snap locking of the tab within the slot.

6. In a carton folded from a blank, multiple longitudinal aligned adjacent compartments, each compartment including a base panel having opposed first and second longitudinal edges and opposed transverse edges, a longitudinal planar side wall panel integral with and upwardly extending from each base panel along and generally coextensive with each longitudinal edge thereof, the side wall panels along each of the first and second longitudinal edges of the compartments being in general longitudinal alignment, a transverse partition section upwardly folded between base panels of adjacent compartments and adjacent transverse edges thereof, said partition section having a central fold area longitudinally therealong defining a partition panel to each side thereof, each partition panel being integral with the adjacent transverse edge of an adjacent base panel and defining a transverse wall of the corresponding compartment, said partition panels diverging downward from the central fold area therebetween, the side wall panels aligned along each of the longitudinal edges of the adjacent compartments having adjacent end portions, said partition section having a pair of glue flaps at each end thereof, said glue flaps extending parallel to the side wall panels and into overlapping bonded engagement with the adjacent end portions of the side wall panels of the adjacent compartments, each of said adjacent end portions of the side wall panels having an integral extension upward of and parallel to the glue flaps and extending longitudinally beyond the end portion and into overlapping joined engagement with the aligned side wall panel of the adjacent compartment to rigidly join the aligned side wall panels of adjacent compartments and preclude movement therebetween, said compartments including opposed endmost compartments, each including a transverse outer end wall panel integral with and upwardly extending from the corresponding base panel, each of said end panels including opposed ends bonded to the side wall panels of the corresponding endmost compartments.

7. The carton of claim 6 wherein said side wall panels and said end wall panels diverge upwardly from the base panels.

8. Carton of claim 6 including at least three longitudinally aligned compartments with a transverse partition section between the base panels of each adjacent pair of compartments.

9. The carton of claim 6 wherein one of said outer end wall panels includes an upper edge, a hinge panel extending along said upper edge and being integral therewith along a defined hinge line, and a lid panel integral with said hinge panel along a fold line parallel to said hinge line for selective folding of the lid panel into overlying relation to the multiple compartments.

10. The construction of claim 9 wherein said lid panel is of greater longitudinal length than the multiple longitudinally aligned compartments and of a greater transverse width than said compartments.

11. The construction of claim 10 including an end wall panel integral with and upwardly folded from the lid panel along a fold line parallel to and remote from said hinge panel.

12. The construction of claim 6 including a closure lid overlying said compartments, said lid including peripheral walls.

13. The construction of claim 12 wherein said lid walls are receivable about the carton outward of the compartment side walls.

14. The construction of claim 12 wherein said lid walls are receivable within the compartment walls.

* * * * *